US006591802B1

(12) United States Patent
Pierik

(10) Patent No.: US 6,591,802 B1
(45) **Date of Patent: *Jul. 15, 2003**

(54) VARIABLE VALVE ACTUATING MECHANISM HAVING A ROTARY HYDRAULIC LASH ADJUSTER

(75) Inventor: Ronald J. Pierik, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/120,097

(22) Filed: Apr. 10, 2002

(51) Int. Cl.[7] ..... F01L 1/18

(52) U.S. Cl. ..... 123/90.45; 123/90.15; 123/90.17; 123/90.39; 123/90.43; 123/90.44; 74/559; 74/569

(58) Field of Search ..... 123/90.15, 90.16, 123/90.17, 90.27, 90.31, 90.39, 90.43, 90.44, 90.45; 74/559, 567, 569

(56) References Cited

U.S. PATENT DOCUMENTS 5,080,054 A * 1/1992 Nakamura ..... 123/90.16
5,251,586 A * 10/1993 Koga et al. ..... 123/90.16
5,445,116 A * 8/1995 Hara ..... 123/90.16
5,937,809 A * 8/1999 Pierik et al. ..... 123/90.16
6,019,076 A * 2/2000 Pierik et al. ..... 123/90.16
6,041,746 A * 3/2000 Takemura et al. ..... 123/90.16
6,123,053 A * 9/2000 Hara et al. ..... 123/90.16
6,260,523 B1 * 7/2001 Nakamura et al. ..... 123/90.15
6,386,161 B2 * 5/2002 Pierik ..... 123/90.16
6,386,162 B2 * 5/2002 Himsel ..... 123/90.16
6,390,041 B2 * 5/2002 Nakamura et al. ..... 123/90.15
6,439,178 B1 * 8/2002 Pierik ..... 123/90.16

* cited by examiner

*Primary Examiner*—Thomas Denion
*Assistant Examiner*—Ching Chang
(74) *Attorney, Agent, or Firm*—Patrick M. Griffin

(57) ABSTRACT

A variable valve actuating mechanism includes an output cam configured for being pivotally disposed upon an input shaft. A first link arm is pivotally coupled at a first end thereof to the output cam. A rocker arm is pivotally coupled at a first end thereof to a second end of the link arm. A first frame member is configured for being pivotally disposed upon the input shaft. Lash adjusting means pivotally couple together a first end of the first frame member and a second end of the rocker arm. The lash adjusting means adjusts the position of the rocker arm relative to the input shaft.

18 Claims, 4 Drawing Sheets

VARIABLE VALVE ACTUATING MECHANISM HAVING A ROTARY HYDRAULIC LASH ADJUSTER

TECHNICAL FIELD

The present invention relates to a variable valve actuating mechanism. More particularly, the present invention relates to a variable valve actuating mechanism having a rotary hydraulic lash adjuster.

BACKGROUND OF THE INVENTION

Modern internal combustion engines may incorporate advanced throttle control systems, such as, for example, intake valve throttle control systems, to improve fuel economy and performance. Generally, intake valve throttle control systems control the flow of gas and air into and out of the engine cylinders by varying the timing, duration and/or lift (i.e., the valve lift profile) of the cylinder valves in response to engine operating parameters, such as engine load, speed, and driver input. Intake valve throttle control systems vary the valve lift profile through the use of variously-configured mechanical and/or electromechanical devices, collectively referred to herein as variable valve actuation (VVA) mechanisms. Several examples of particular embodiments of VVA mechanisms are detailed in commonly assigned U.S. Pat. Nos. 5,937,809 and 6,019,076, the disclosures of which are incorporated herein by reference.

Generally, a conventional VVA mechanism includes a rocker arm that carries an input cam follower, such as a roller. The input cam follower engages an opening or input cam lobe of a rotating input shaft, such as the engine camshaft, and transfers rotation of the input cam lobe to oscillation of the rocker arm toward and away from the input shaft in a generally radial direction. The oscillation of the rocker arm is transferred via a link arm to pivotal oscillation of an output cam relative to the input shaft. The pivotal oscillation of the output cam is transferred to actuation of an associated valve by an output cam follower, such as, for example, a roller finger follower. The rocker arm also carries a closing cam follower, such as, for example, a slider pad, that engages a closing cam lobe of the rotary input shaft. The closing cam follower transfers rotation of the closing cam lobe to the rocker arm, thereby ensuring that the output cam is pivoted back or returned to its starting or base angular orientation.

A desired valve lift profile is obtained by pivoting a control shaft into a predetermined angular orientation relative to a centerline thereof. A frame member is pivotally coupled at one end thereof to the control shaft and at the other end thereof to the rocker arm. The pivotal movement of the control shaft is transferred, via the frame, rocker arm and link arm, to pivotal movement of the output cam relative to a central axis of the input shaft. Thus, pivoting the control shaft places the output cam into the base or starting angular orientation. The base or starting angular orientation of the output cam, in turn, determines the portion of the lift profile thereof that will engage the output cam follower during pivotal oscillation of the output cam. The lift profile of the output cam that engages the cam follower determines the valve lift profile.

Conventional VVA mechanisms may also include a lash adjustment means. The lash adjustment means is adjusted during assembly of the VVA mechanism and/or engine to compensate for manufacturing tolerances and/or component dimensional variation, thereby removing lash from the mechanism. This adjustment step or process in the assembly of the mechanism or engine is time consuming and labor intensive. Further adjustment of the lash adjustment means is typically required periodically thereafter, such as, for example, to compensate for wear and tear of mechanism components. Such further adjustment requires a vehicle owner to return the vehicle to a service provider for periodic maintenance.

Therefore, what is needed in the art is a VVA mechanism having a lash adjustment means that reduces and/or eliminates the need for manual adjustment of lash during assembly and/or installation of the VVA mechanism.

Furthermore, what is needed in the art is a VVA mechanism having a lash adjustment means that substantially reduces the need for periodic adjustment/maintenance to reduce/remove the lash from the VVA mechanism.

Still further, what is needed in the art is VVA mechanism having a lash adjustment means that automatically reduces/removes lash from the VVA mechanism.

Moreover, what is needed in the art is a VVA mechanism having an automatic lash adjustment means that substantially reduces and/or eliminates the need for periodic maintenance and/or manual adjustment in order to reduce/remove lash.

SUMMARY OF THE INVENTION

The present invention provides a variable valve actuating mechanism having automatic lash adjustment.

The present invention comprises, in one form thereof, an output cam configured for being pivotally disposed upon an input shaft. A first link arm is pivotally coupled at a first end thereof to the output cam. A rocker arm is pivotally coupled at a first end thereof to a second end of the link arm. A first frame member is configured for being pivotally disposed upon the input shaft. Lash adjusting means pivotally couple together the first end of the first frame member and the second end of the rocker arm. The lash adjusting means adjusts the position of the rocker arm relative to the input shaft.

An advantage of the present invention is that the need for manual adjustment of lash during assembly of a VVA mechanism is substantially reduced.

Another advantage of the present invention is that the need for periodic adjustment/maintenance to reduce/remove lash in the VVA mechanism is substantially reduced.

A further advantage of the present invention is that lash is automatically reduced/removed from the VVA mechanism.

A still further advantage of the present invention is that the need for periodic maintenance and/or manual adjustment of the VVA mechanism in order to reduce/remove lash therefrom is substantially reduced.

BRIEF DESCRIPTION OF THE DRAWINGS

The above-mentioned and other features and advantages of this invention, and the manner of attaining them, will become apparent and be more completely understood by reference to the following description of one embodiment of the invention when read in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENTS

Figure 1:
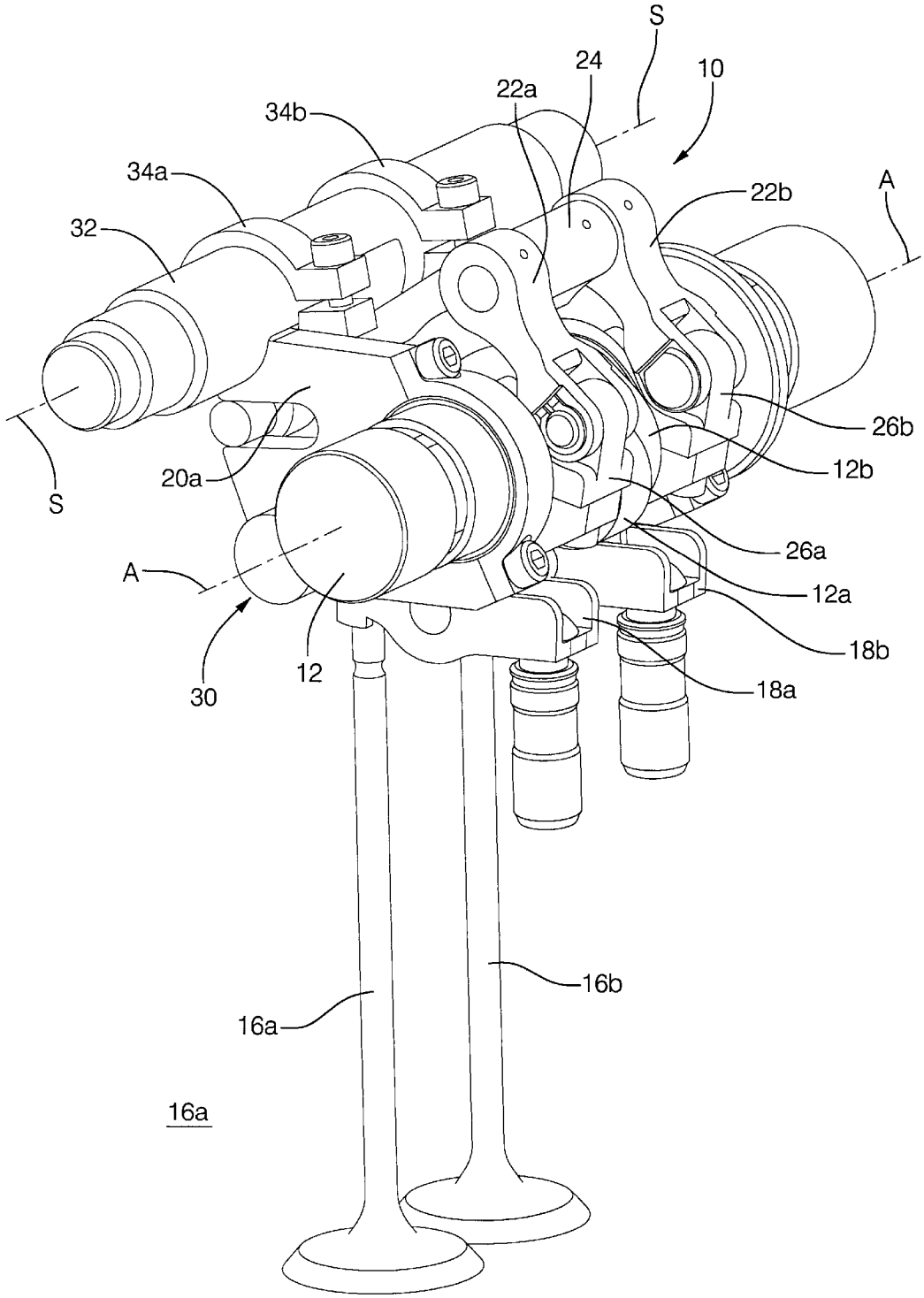
FIG. 1 is a perspective, front view of one embodiment of a variable valve actuating (VVA) mechanism having a rotary hydraulic lash adjuster of the present invention.
Figure 2:
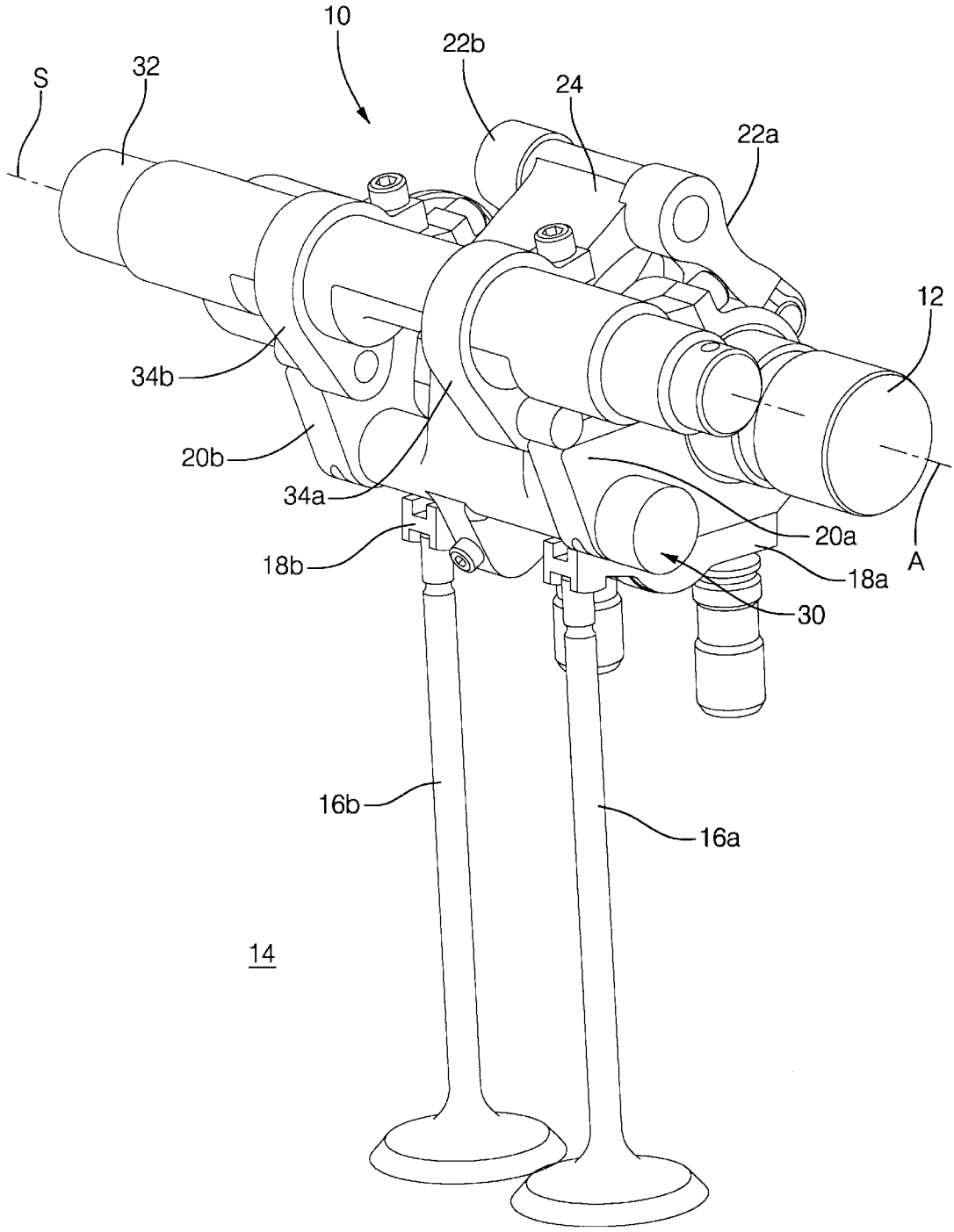
FIG. 2 is a perspective, rear view of the VVA of FIG. 1.

Referring to the drawings, and particularly to FIGS. 1 and 2, there is shown one embodiment of a variable valve actuating (VVA) mechanism having a rotary hydraulic lash adjuster (RHLA) of the present invention.

VVA mechanism 10, as is known in the art, is operably associated with rotary input shaft or camshaft 12 (hereinafter referred to as camshaft 12) of engine 14. Camshaft 12 has a central axis A, and includes an input cam lobe 12*a* and a closing cam lobe 12*b*. Cam lobes 12*a* and 12*b* rotate as substantially one body with camshaft 12. Valves 16*a* and 16*b* are associated with a cylinder (not shown) of engine 14 and with respective cam followers 18*a* and 18*b*.

VVA mechanism 10 includes frame members 20*a* and 20*b*, link arms 22*a* and 22*b*, rocker arm assembly 24, output cams 26*a* and 26*b*, and rotary hydraulic lash adjuster (RHLA) 30. Generally, VVA mechanism 10 transfers rotation of input cam lobe 12*a* to pivotal oscillation of output cams 26*a* and 26*b* to thereby actuate valves 16*a* and 16*b* according to a desired valve lift profile.

Frame members 20*a* and 20*b* are pivotally disposed on camshaft 12 on respective sides of input and closing cam lobes 12*a* and 12*b*, respectively. Frame members 20*a* and 20*b*, as will be more particularly described hereinafter, are pivotally coupled to rocker arm assembly 24. Frame members 20*a* and 20*b* are also pivotally coupled to control shaft 32 by respective coupling means 34*a* and 34*b*, such as, for example, shaft clamps.

Link arms 22*a* and 22*b* are elongate arm members that are pivotally coupled at a first end thereof to opposite sides of rocker arm assembly 24 and at a second end thereof to a respective output cam 26*a* and 26*b*.

Rocker arm assembly 24 is pivotally coupled, as will be more particularly described hereinafter, at a first end thereof to frame members 20*a*, 20*b*. Rocker arm assembly 24 is pivotally coupled, such as, for example, by pins, at a second end thereof to link arms 22*a* and 22*b*. Rocker arm assembly 24, as is known in the art, carries an input cam follower (not shown) and a closing cam follower (not shown), such as, for example, rollers or slider pads (not shown), that engage a corresponding one of input and closing cams 12*a* and 12*b*.

Output cams 26*a* and 26*b* are pivotally disposed upon camshaft 12. More particularly, output cam 26*a* is pivotally disposed upon camshaft 12 on a first side of input and closing cam lobes 12*a*, 12*b* and output cam 26*b* is disposed on a second side of input and closing cam lobes 12*a*, 12*b*. Output cam 26*a* is pivotally coupled to link arm 22*a* and output cam 26*b* is pivotally coupled to link arm 22*b*.

In use, VVA mechanism 10 actuates and varies the valve lift of valves 16*a*, 16*b*, in a generally similar manner to that of a conventional VVA mechanism. Generally, VVA mechanism 10 converts rotation of camshaft 12 to a fixed range of pivotal oscillation of output cams 26*a* and 26*b* relative to central axis A. More particularly, as described above, input cam lobe 12*a* engages the corresponding cam follower (not shown) carried by rocker arm 24. Rotation of input cam lobe 12*a* thus displaces rocker arm 24 in a generally radial direction away from central axis A. The displacement of rocker arm 24 is transferred via link arms 22*a* and 22*b* to pivotal movement of output cams 26*a* and 26*b* in a counterclockwise direction relative to central axis A of camshaft 12.

Closing cam 12*b* is a predetermined amount out of phase relative to input cam lobe 12*a*. Closing cam 12*b* engages the corresponding cam follower carried by rocker arm 24 to return output cams 26*a* and 26*b* to a base or starting angular orientation relative to central axis A of camshaft 12. More particularly, as input cam lobe 12*a* rotates from the lift or nose portion of its profile toward a lower lift or base circle portion, the lift portion of closing cam lobe 12*b* engages the corresponding cam follower carried by rocker arm 24. Closing cam lobe 12*b* displaces, or pulls, rocker arm 24 in a generally radial direction toward central axis A of camshaft 12, thereby pivoting (via link arms 22*a* and 22*b*) output cams 26*a* and 26*b* back to their base or starting angular orientation.

A desired valve lift profile for associated valves 16*a*, 16*b* is obtained by placing control shaft 32 in a predetermined angular orientation relative to central axis S (FIGS. 1 and 2) thereof. The pivoting of control shaft 32 is transferred via frame members 20*a*, 20*b*, rocker arm 24, and link arms 22*a* and 22*b* to pivoting of output cams 26*a* and 26*b* relative to central axis A of camshaft 12. Thus, the desired portion of the lift profiles of output cams 26*a* and 26*b* are disposed within the pivotal oscillatory range thereof relative to cam followers 18*a*, 18*b*. As output cams 26*a*, 26*b* are pivotally oscillated, the desired portions of the lift profiles thereof engage cam followers 18*a*, 18*b* to thereby actuate valves 16*a* and 16*b* according to the desired lift profile.

Although VVA 10 mechanism actuates and varies the lift profile of valves 16*a* and 16*b* in a manner generally similar to a conventional VVA mechanism, the automatic reduction and/or removal of lash distinguishes VVA mechanism 10 relative to a conventional VVA mechanism. As will be described more particularly hereinafter, RHLA 30 automatically reduces and/or removes the lash within VVA mechanism 10.

Figure 3:
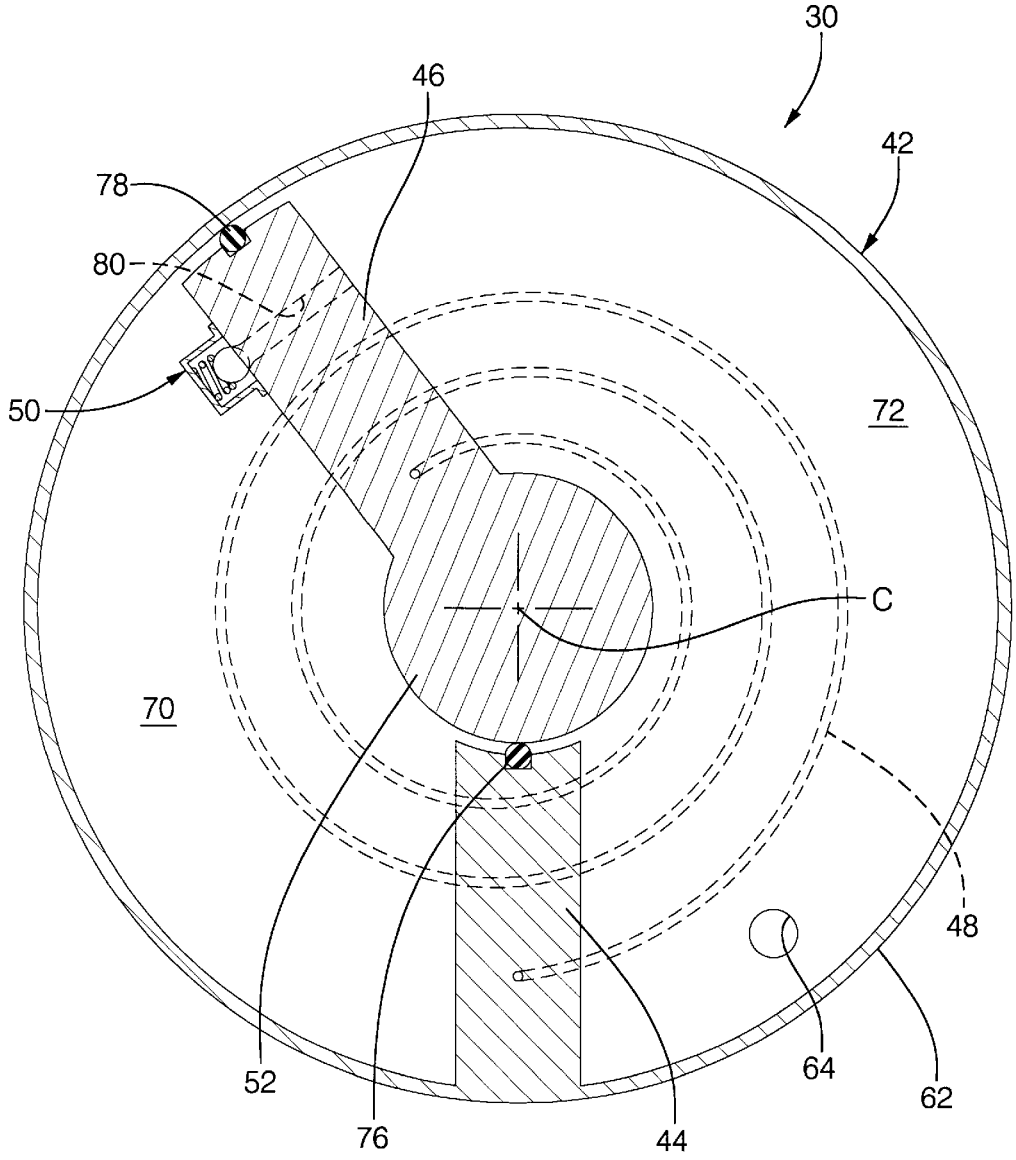
FIG. 3 is a front, cross-sectional view of one embodiment of the rotary hydraulic lash adjuster of FIG. 1.
Figure 4:
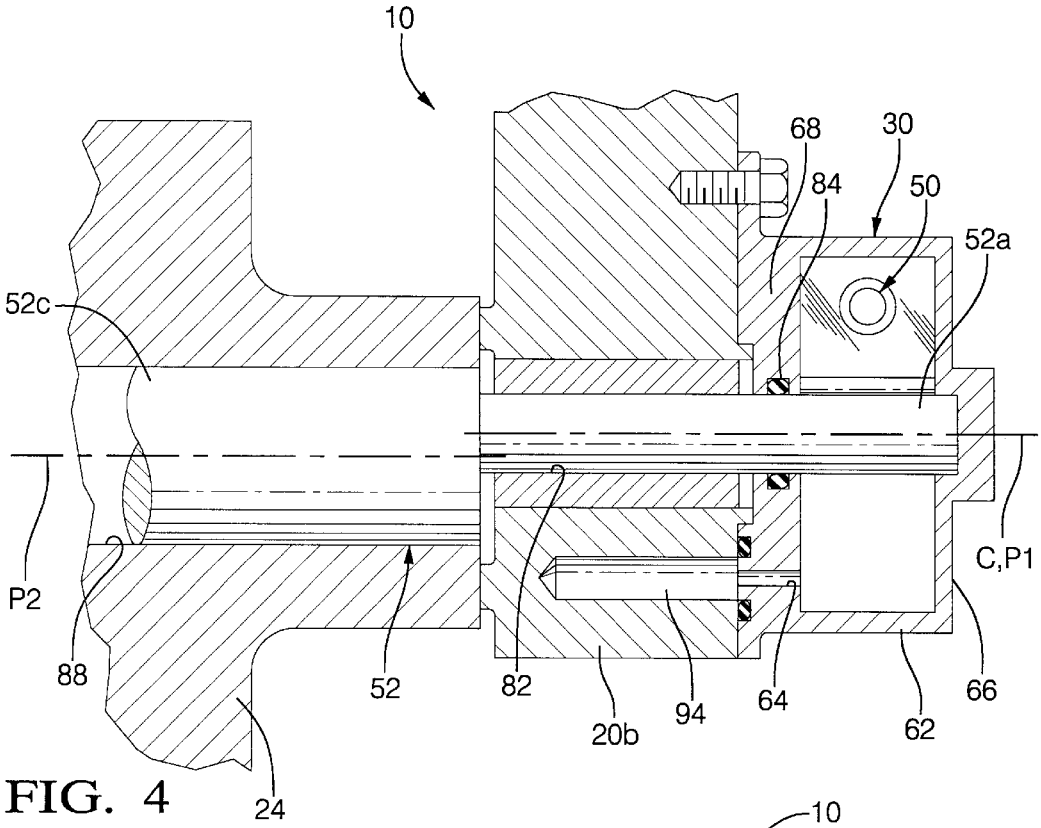
FIG. 4 is a partial, axially-sectioned view of the VVA mechanism of FIG. 1.
Figure 5:
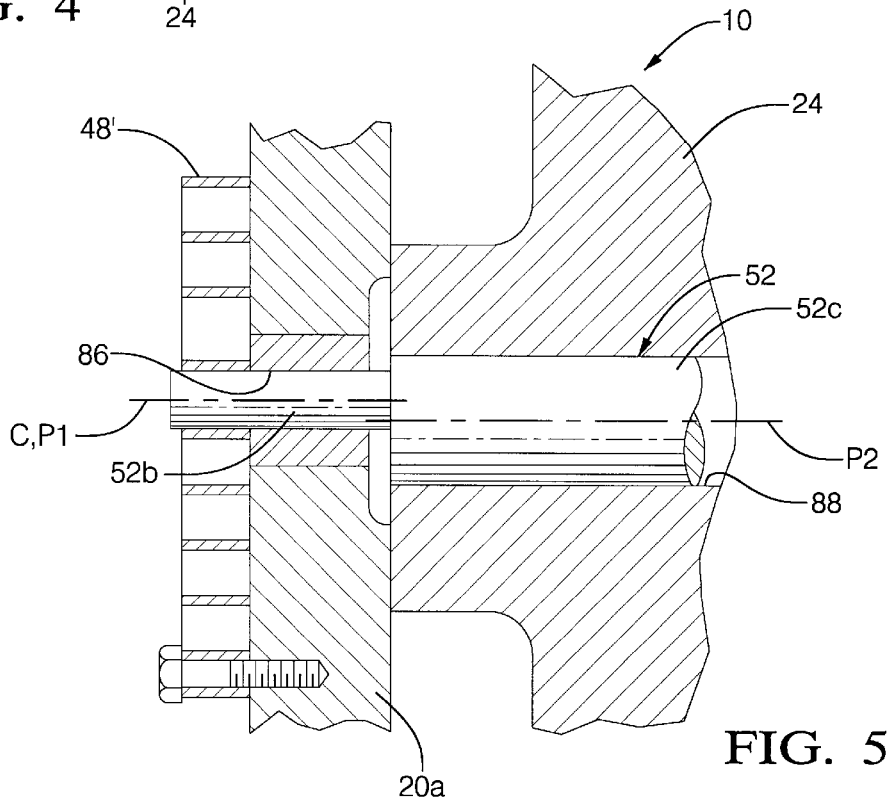
FIG. 5 is a partial, axially-sectioned view of the VVA mechanism of FIG. 1.

RHLA 30, as best shown in FIGS. 3–5, includes cylinder 42, fixed vane 44, movable vane 46, biasing means 48, valve assembly 50 and eccentric shaft or pin 52. Generally, eccentric pin 52 pivotally couples frame members 20*a* and 20*b* to rocker arm 24, and enables the position of rocker arm 24 to be adjusted in a generally radial direction toward and away from camshaft 12 to thereby adjust and/or reduce lash in VVA mechanism 10.

Cylinder 42 is a cylindrical body having central axis C, and contains a hydraulic fluid (not shown) such as, for example, oil. Cylinder 42 includes sidewall 62, fluid port 64, top 66 (FIG. 4) and bottom 68 (FIG. 4). Each of top 66 and bottom 68 are attached in a fluid and fluid tight manner to sidewall 62 at respective and opposite ends (not referenced) thereof. Fluid port 64 is defined by bottom 68. Cylinder 42 further includes high-pressure chamber 70 and low-pressure chamber 72. High-pressure chamber 70 is defined by a corresponding portion of sidewall 62, fixed vane 44 and movable vane 46. Low-pressure chamber 72 is defined by a corresponding portion of sidewall 62, fixed vane 44 and movable vane 46. Cylinder 42 is affixed, such as, for example, by bolts or other fasteners, to frame member 20*b*.

Fixed vane 44 is disposed within cylinder 42, and includes outer and inner ends (not referenced). The outer end is fixed to and/or integral with sidewall 62 of cylinder 42. Inner seal 76 is disposed on the inner end of fixed vane 44 and engages eccentric pin 52 in a fluid tight manner. Fixed vane 44 extends axially through cylinder 42 and is in sealing engagement with each of top 66 and bottom 68 of cylinder 42.

Movable vane 46 includes an inner end and an outer end (neither of which is referenced). The inner end of movable vane 46 is in sealing engagement and/or integral with eccentric pin 52. Thus, eccentric pin 52 and movable vane 46 pivot or rotate as substantially one body. Outer seal 78 is disposed on the outer end of movable vane 46 and engages the inner surface (not referenced) of sidewall 62 in a fluid tight manner. Movable vane 46 extends axially through cylinder 42 and is in sealing engagement with each of the top 66 and bottom 68 of cylinder 42. Movable vane 46 defines fluid passageway 80 therethrough, which fluidly connects high and low pressure chambers 70 and 72, respectively.

Biasing means 48, such as, for example, a torsion and/or coil spring, engages or is affixed at one end (not referenced) thereof to movable vane 46 and at the other end (not referenced) thereof to fixed vane 44 or to eccentric pin 52. Biasing means 48 applies a clockwise-directed torque upon movable vane 46 to thereby rotate eccentric pin 52 in a clockwise direction and remove lash from VVA mechanism 10, as will be more particularly described hereinafter.

Valve assembly 50 is a conventional check ball type valve that controls the flow of working fluid within cylinder 42 between high and low pressure chambers 70 and 72, respectively. Valve assembly 50 is disposed on movable vane 46 and in association with fluid passageway 80 defined thereby.such that valve assembly 50 controls the flow of fluid through passageway 80 between high and low pressure chambers 70 and 72, respectively.

Eccentric pin 52, as best shown in FIGS. 4 and 5, is an elongate pin member having first and second portions 52*a* (FIG. 4) and 52*b* (FIG. 5), respectively, having a common centerline P1, and an eccentric portion 52*c* having a centerline P2. Centerline P1 and P2 are substantially parallel relative to and spaced apart from each other. Centerlines P1 and P2 are spaced apart from each other from approximately 0.025 millimeters (mm) to approximately 5.00 mm.

A first segment (not referenced) of first portion 52*a* of eccentric pin 52 disposed within cylinder 42 such that centerline P1 thereof is substantially coaxial with central axis C of cylinder 42. First portion 52*a* extends axially through bottom 68 of cylinder 42 such that a second segment (not referenced) of first portion 52*a* is pivotally disposed within frame-to-rocker pin bore 82 formed in frame member 20*b*. The interface of bottom 68 and first portion 52*a* of eccentric pin 52 is sealed by seal 84 in a fluid tight manner to prevent fluid from escaping from within cylinder 42.

Second portion 52*b* of eccentric pin 52 extends axially from eccentric portion 52*c* at an end thereof that is opposite to first portion 52*a*. Second portion 52*b* is disposed at least partially within frame-to-rocker pin bore 86 formed in frame member 20*a*.

Eccentric portion 52*c* (not referenced) of eccentric pin 52 extends axially from first portion 52*a* to second portion 52*b*. Eccentric portion 52*c* is disposed at least partially within and extends through rocker-to-frame pin bore 88 formed in rocker arm 24.

In use, VVA 10 mechanism actuates and varies the lift profile of valves 16*a* and 16*b* in a generally similar manner to a conventional VVA mechanism. However, VVA mechanism 10 includes RHLA 30, which automatically reduces and/or removes lash from. VVA mechanism 10 and which distinguishes VVA mechanism 10 from a conventional VVA mechanism. Generally, RHLA 30 removes lash from VVA mechanism 10 by rotating eccentric pin 52 which, in turn, adjusts the radial position of rocker arm 24 relative to central axis A of camshaft 12.

More particularly, and as stated above, biasing means 48 applies a force in the clockwise direction directly upon eccentric pin 52 or indirectly upon eccentric pin 52 via movable vane 46. With the input and closing cam followers (not referenced) carried by rocker arm 24 in engagement with the base circle portions of input cam 12*a* and closing cam 12*b*, respectively, VVA mechanism 10 is in a condition of low applied force or torque. Under this condition of low applied force, the predetermined force applied directly or indirectly to eccentric pin 52 by biasing means 48 is greater than the fluid pressure within low-pressure chamber 72. Thus, movable vane 46 is caused to pivot in the clockwise direction, thereby unseating the ball of valve assembly 50 and enabling oil to flow from low-pressure chamber 72 into high-pressure chamber 70.

The clockwise pivoting of moving vane 46 is transferred to clockwise pivoting of eccentric pin 52, which is affixed to and/or integral with moving vane 46. Thus, as eccentric pin 52 pivots in a clockwise direction, centerline P2 of eccentric section 52*c* pivots relative to centerline P1 of first and second sections 52*a*, 52*b*. The clockwise pivoting of eccentric pin 52 adjusts the position of rocker arm 24 in a generally radial direction toward camshaft 12 until the input and closing cam followers carried by rocker arm 24 engage input cam 12*a* and closing cam 12*b*, respectively, thereby removing lash from VVA mechanism 10. Eccentric pin 52 pivots until the cam followers engage their corresponding cams, at which point further clockwise pivoting thereof is precluded by the engagement of the followers with the respective cams.

As the input cam 12*a* and closing cam 12*b* rotate out of an orientation wherein the base circle portions thereof are in engagement with a corresponding cam follower, and into an orientation wherein a lift portion of the profiles thereof engage a corresponding cam, force levels within VVA mechanism 10 increase relative to the force levels present in the base circle situation described above. The increased force levels within VVA mechanism 10 tends to pivot eccentric pin 52 in a counterclockwise direction, which would require that fluid flow from high-pressure chamber 70 into low-pressure chamber 72. However, valve assembly 50 substantially precludes fluid from flowing through passageway 80 and into low-pressure chamber 72. Thus, movable vane 46 and eccentric pin 52 are substantially precluded from pivotal movement, and the lash within VVA mechanism 10 remains substantially unchanged.

It should be particularly noted when the force levels within VVA mechanism 10 increase relative to the force levels present in the base circle situation, RHLA 30 is designed to permit a certain amount of fluid to gradually escape from high-pressure chamber 70 and into low-pressure chamber 72. That is, RHLA 30 is designed with a controlled leakage, provided by, for example, an orifice or dimensional clearances, between high-pressure chamber 70 and low-pressure chamber 72. Accordingly, under such an increased or high-force condition, movable vane 46 and eccentric pin 52 are pivoted slightly in a counterclockwise direction thereby slightly increasing the amount of lash within VVA mechanism 10. This slight increase in the lash is necessary to compensate for thermal expansion and/or growth of components within VVA mechanism 10.

It should further be particularly noted that, as shown in FIG. 4, RHLA 30 is fluidly coupled to a source of hydraulic fluid, such as, for example, oil. More particularly, fluid port or inlet 64 of cylinder 42 is, when in use, in fluid communication with a source of pressurized hydraulic fluid, such as, for example, oil supply 94.

Moreover, it should be particularly noted that, as shown in the drawings, optional bearings (not referenced) are disposed between eccentric pin 52 and each of frame member 20*b* (i.e., in frame-to-rocker pin bore 82 formed in frame member 20*b*) and frame member 20*a* (i.e., within frame-to-rocker pin bore 86 formed in frame member 20*a*).

In the embodiment shown, biasing means 48 is disposed within cylinder 42. However, as shown in FIG. 5, the present invention can be alternately configured with biasing means 48' affixed to frame member 20*a* and to second portion 52*b* of eccentric pin 52 to thereby bias movable vane 46 in a clockwise direction. Furthermore, the present invention can be alternately configured with the biasing means placed virtually any place that is convenient for a particular application.

In the embodiment shown, VVA mechanism 10 is configured with RHLA 30 having one movable vane and one fixed vane. However, it is to be understood that the present invention can be alternately configured with a RHLA having multiple vanes to increase stiffness and/or reduce the size of the RHLA.

In the embodiment shown, RHLA 30 is configured with a separate cylinder 42 that is affixed to frame member 20*b* of VVA mechanism 10. However, it is to be understood that the present invention can be alternately configured, such as, for example, with a cylinder that is integral with and/or defined within one of the frame members of the VVA mechanism.

In the embodiment shown, RHLA 30 includes a conventional check ball type valve to control the flow of fluid between the two chambers. However, it is to be understood that the present invention can be alternately configured with other types of valves, such as, for example, a flapper valve or other suitable type of fluid control valve.

In the embodiment shown, VVA mechanism 10 is shown as having a particular and specific desmodronic configuration. However, it is to be understood that the present invention can be alternately configured, such as, for example, with variously configured desmodronic variable valve actuation mechanisms.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed is:

1. A variable valve actuating mechanism, comprising:

an output cam configured for being pivotally disposed upon an input shaft;

a first link arm pivotally coupled at a first end thereof to said output cam;

a rocker arm pivotally coupled at a first end thereof to a second end of said link arm;

a first frame member configured for being pivotally disposed upon the input shaft; and lash adjusting means pivotally coupling together a first end of said first frame member and a second end of said rocker arm, said lash adjusting means configured for adjusting a position of said rocker arm relative to the input shaft.

2. A variable valve actuating mechanism, comprising:

an output cam configured for being pivotally disposed upon an input shaft;

a first link arm pivotally coupled at a first end thereof to said output cam;

a rocker arm pivotally coupled at a first end thereof to a second end of said link arm;

a first frame member configured for being pivotally disposed upon the input shaft; and lash adjusting means configured for adjusting a position of said rocker arm relative to the input shaft, said lash adjusting means including:

a cylinder having a cylinder central axis, a sidewall, a top and a bottom, said sidewall interconnected with said top and bottom in a fluid tight manner, said cylinder configured for containing a fluid; and an elongate eccentric pin pivotally coupling together said first frame member and said rocker arm, said eccentric pin pivoted relative to said cylinder central axis by fluid pressure within said cylinder to thereby adjust the position of said rocker arm relative to said input shaft.

3. The variable valve actuating mechanism of claim 2, wherein:

said eccentric pin further comprises:

a first portion having a first centerline, said first centerline being substantially coaxial with said central axis of said cylinder, said first portion having an internal and external segment, said internal segment being disposed within said cylinder, said external segment being disposed external to said cylinder, said first end of said first frame member being pivotally associated with said external segment;

a second portion adjoining said external segment of said first portion, said second portion disposed external to said cylinder and having a second centerline, said second centerline being spaced apart from and substantially parallel relative to said first centerline, said rocker arm being pivotally associated with said second portion; and said cylinder further comprises:

a movable vane in sealing engagement with said top and said bottom of said cylinder, said movable vane having an inner end and an outer end, said inner end being one of affixed to and integral with said internal segment of said first portion of said eccentric pin, said outer end sealingly engaging said sidewall; and a fixed vane disposed in sealing engagement with each of said sidewall, said top, said bottom and said internal segment of said eccentric pin.

4. The variable valve actuating mechanism of claim 3, wherein said first and said second centerlines are separated by from approximately 0.025 millimeters (mm) to approximately 5.0 mm.

5. The variable valve actuating mechanism of claim 3, wherein said second end of said rocker arm defines a rocker arm bore therethrough, said first end of said first frame member defines a first frame bore therethrough, said external segment of said first portion of said eccentric pin being pivotally disposed at least partially within said first frame bore, said second portion of said eccentric pin being pivotally disposed at least partially within said rocker arm bore.

6. The variable valve actuating mechanism of claim 5, further comprising:

a second frame member having a first end, said first end defining a second frame bore therethrough, said second frame member being pivotally disposed upon the input shaft; and wherein said eccentric pin includes a third portion substantially concentric relative to said first centerline, said third portion adjoining said second portion at an end thereof opposite said first portion, said third portion being pivotally disposed at least partially within said second frame bore.

7. The variable valve actuating mechanism of claim 3, wherein said lash adjusting means further comprises:

a first chamber conjunctively defined by said fixed vane, said movable vane and said sidewall, said first chamber configured for containing a fluid; and a second chamber conjunctively defined by said fixed vane, said movable vane and said sidewall, said second chamber configured for containing a fluid;

a fluid port in fluid communication with said first chamber;

a fluid passageway fluidly connecting said first and second chambers; and valve means disposed in said second chamber and controlling the flow of fluid through said fluid passageway.

8. The variable valve actuating mechanism of claim 3, further comprising a biasing means rotationally biasing in one of a direct or indirect manner said eccentric pin and said movable vane in a direction such that said first chamber increases in volume.

9. The variable valve actuating mechanism of claim 8, wherein said biasing means comprises a torsion spring disposed within said cylinder, said torsion spring engaging each of said fixed vane and one of said movable vane and said eccentric pin.

10. The variable valve actuating mechanism of claim 8, wherein said biasing means comprises a torsion spring disposed external to said cylinder and engaging said eccentric pin.

11. The variable valve actuating mechanism of claim 2, wherein said cylinder is one of affixed to and connected to said first frame member.

12. The variable valve actuating mechanism of claim 2, wherein said cylinder is integral and monolithic with said first frame member.

13. An internal combustion engine, comprising:

an input shaft; and a variable valve actuating mechanism, including:

an output cam pivotally disposed upon said input shaft;

a first link arm pivotally coupled at a first end thereof to said output cam;

a rocker arm pivotally coupled at a first end thereof to a second end of said link arm;

a first frame member pivotally disposed upon said input shaft; and lash adjusting means pivotally coupling together a first end of said first frame member and a second end of said rocker arm, said lash adjusting means adjusting a position of said rocker arm relative to said input shaft.

14. An internal combustion engine, comprising:

an input shaft; and a variable valve actuating mechanism, including:

an output cam pivotally disposed upon said input shaft;

a first link arm pivotally coupled at a first end thereof to said output cam;

a rocker arm pivotally coupled at a first end thereof to a second end of said link arm;

a first frame member pivotally disposed upon said input shaft; and lash adjusting means for adjusting a position of said rocker arm relative to said input shaft, said lash adjusting means including a cylinder and an elongate eccentric pin, said cylinder having a cylinder central axis, a sidewall, a top and a bottom, said sidewall interconnected with said top and bottom in a fluid tight manner, said cylinder configured for containing a fluid, said elongate eccentric pin pivotally coupling together said first frame member and said rocker arm, said eccentric pin pivoted relative to said cylinder central axis by fluid pressure within said cylinder to thereby adjust the position of said rocker arm relative to said input shaft.

15. The internal combustion engine of claim 14, wherein:

said eccentric pin further comprises:

a first portion having a first centerline, said first centerline being substantially coaxial with said central axis of said cylinder, said first portion having an internal and external segment, said internal segment being disposed within said cylinder, said external segment being disposed external to said cylinder, said first end of said first frame member being pivotally associated with said external segment;

a second portion adjoining said external segment of said first portion, said second portion disposed external to said cylinder and having a second centerline, said second centerline being spaced apart from and substantially parallel relative to said first centerline; and said cylinder further comprises:

a movable vane in sealing engagement with said top and said bottom of said cylinder, said movable vane having an inner end and an outer end, said inner end being one of affixed to and integral with said internal segment of said first portion of said eccentric pin, said outer end sealingly engaging said sidewall; and a fixed vane disposed in sealing engagement with each of said sidewall, said top, said bottom and said internal segment of eccentric pin.

16. The internal combustion engine of claim 15, wherein said first and said second centerlines are separated by from approximately 0.025 millimeters (mm) to approximately 5.0 mm.

17. The internal combustion engine of claim 15, wherein said second end of said rocker arm defines a rocker arm bore therethrough, said first end of said first frame member defines a first frame bore therethrough, said external segment of said first portion of said eccentric pin being pivotally disposed at least partially within said first frame bore, said second portion of said eccentric pin being pivotally disposed at least partially within said rocker arm bore.

18. The internal combustion engine of claim 17, further comprising:

a second frame member having a first end, said first end defining a second frame bore therethrough, said second frame member being pivotally disposed upon said input shaft; and wherein said eccentric pin includes a third portion substantially concentric relative to said first centerline, said third portion adjoining said second portion at an end thereof opposite said first portion, said third portion being pivotally disposed at least partially within said second frame bore.

* * * * *